United States Patent [19]

Kawai et al.

[11] 4,343,744

[45] Aug. 10, 1982

[54] PROCESS FOR SEPARATING A SPECIFIED COMPONENT CONTAINED IN A MIXTURE OF MULTIPLE FATTY COMPONENTS FROM THE MIXTURE THEREOF

[75] Inventors: Jun Kawai, Hachioji; Hidekazu Bessyo, Yokohama; Hidehiko Hibino, Tokyo, all of Japan

[73] Assignee: Nippon Oil and Fats Co., Ltd., Tokyo, Japan

[21] Appl. No.: 221,742

[22] Filed: Dec. 31, 1980

[30] Foreign Application Priority Data

Jan. 7, 1980 [JP] Japan ..... 55-29

[51] Int. Cl.[3] ..... C11B 7/00

[52] U.S. Cl. ..... 260/412.1; 260/410.7; 260/412.4; 260/412.8; 260/419; 260/428.5

[58] Field of Search ..... 260/412.4, 412.8, 428.5, 260/410.7, 412.1, 419

[56] References Cited

U.S. PATENT DOCUMENTS 3,450,727 6/1969 Going et al. ..... 260/428.5

4,129,583 12/1978 Zondek ..... 260/428.5

*Primary Examiner*—John F. Niebling

*Attorney, Agent, or Firm*—Blanchard, Flynn, Thiel, Boutell & Tanis

[57] ABSTRACT

A mixture of multiple fatty components is cooled rapidly by employing an ultra-low temperature refrigerant, whereby the mixture is converted into brittle granulates of fine particles. Each granulate is very low in mutual solubility with other components.

The said granulates are heated up to the vicinity of the lowest freezing temperature amoung those of the whole compounds of the mixture and are kept at the said temperature, whereby the compound having the lowest freezing temperature is mainly melted and it is separated from the said mixture of multiple components.

10 Claims, No Drawings

PROCESS FOR SEPARATING A SPECIFIED COMPONENT CONTAINED IN A MIXTURE OF MULTIPLE FATTY COMPONENTS FROM THE MIXTURE THEREOF

BACKGROUND OF THE INVENTION

Field of the Invention

This invention relates to a process for separating a specified component contained in a mixture of multiple fatty components from a mixture thereof.

In the past, there has been used a solid-liquid separation process for the separation or concentration of a specified component from a mixture of multiple fatty components in which the specified component is converted in phase from a liquid to a solid by changing the temperature conditions.

However, the solid-liquid separation process has an essential drawback in that the crystallization takes a long time and it also has another defect of low fractionation efficiency.

For these reasons, attempts have been made to ameliorate these drawbacks of the solid-liquid separation process in which a solvent or a crystallization aiding agent has been used.

However, the problems involved in the solid-liquid separation process have not yet been solved.

An additional problem is that even if a desired component is crystallized to separate it from the other components by using a solvent, it is necessary to repeat the fractionation step 2 or 3 times since contamination of the desired component by many other components in large amounts occurs due to the low fractionation efficiency.

Moreover, it is necessary to hold the solution for aging at a specified temperature for long time in the fractionation step and therefore, there are drawbacks in that large scale installations and working spaces, huge amounts of energy and much labor are needed.

Additional problems are that it takes from several to several hundred hours for the formation and growth of crystals, which is effected by factors such as the existence or absence of a crystallization seed, species and amount of solvent, figure of crystals and cooling rate, to achieve the differenciation. Also, the fractionation efficiency is considerably reduced in a multiple component system since supercooling phenomena may occur in almost all cases during the cooling process which inhibit the specified component from crystallizing at the predetermined temperature.

SUMMARY OF THE INVENTION

It is an object of this invention to provide a process for separating a specified component in a short time from a mixture of fatty compounds which are difficult to separate.

Another object of this invention is to provide a process for separating a specified component with a good efficiency from a mixture of fatty compounds.

A further object of this invention is to provide a process for separating a specified component from a mixture of fatty compounds, which does not require an installation of large floor space nor huge amounts of energy or labors.

This invention is based on the following findings:

(1) Rapid cooling of a mixture of fatty components using an ultra-low temperature refrigerant results in that the mixture is converted into a brittle solidified product, from which fine granulates are easily produced by stirring.

(2) The resulting individual crystals, which are produced by cooling a mixture of fatty components using an ultra low temperature refrigerant to solidify whole components of the mixture composition, have very little mutual solubility with other components;

(3) A compound having the lowest freezing temperature can be critically separated from other compounds through solid-liquid separation by cooling a mixture composition of fatty components using an ultra-low temperature refrigerant to solidify all the components of the mixture composition, then heating the solidification product to raise the temperature to the vicinity of the lowest freezing temperature among those of the components and holding that temperature, whereby the compound having the lowest freezing temperature is melted; and (4) Fractionation efficiency is further improved by using a suitable solvent in the solid-liquid separation, stated in the above sub-paragraph (3).

The essential feature of this invention lies in a process for separating a specified component from a mixture of multiple fatty components, which process comprises solidifying a liquid mixture having a plurality of components by using an ultra-low temperature refrigerant, heating the resulting solidification product to a temperature corresponding to or slightly higher than the lowest one among the freezing points of the components to be separated whereby to melt a fraction containing as the main constituent the component having the lowest freezing point, subjecting the resulting mixture consisting of components remaining in the solid and liquefied states to a solid-liquid separation to separate the first (fused) liquid components from the first remaining solid components, heating again the first remaining solid components in the same manner to melt the component having the lowest freezing point among the components to be separated from the first remaining solid components, subjecting the resultant second mixture composition to a second solid-liquid separation to separate the second liquid component from the second remaining solid components and repeating the heating and solid-liquid separation steps in the same manner as in the foregoing steps.

The fatty mixtures to which the process of this invention can be applied involve all liquid or solid fatty substances of natural origin and artifically synthesized ones.

Examples of the mixture are animal or vegetable oils and fats, cracked products and derivatives thereof such as glycerides, waxes, fatty acids, fatty acid esters, higher alcohols, vitamins, phospholipids and the like, perfumes and essential oils such as terpene compounds, aldehydes and ketones.

The process of this invention is especially suitable for application to the separation and concentration of highly unsaturated $\omega_3$ family $C_{22}$:6 and $C_{20}$:5 (fatty) acids and the like which are physiologically active substances, from fish oils and liver oils.

Examples of the ultra-low temperature refrigerants are liquid nitrogen (b.p. −196° C.), liquid oxygen (b.p. −183° C.), liquid air (b.p. −194° C.), liquefied natural gases (b.p. −160° C.), liquid hydrogen (b.p. −253° C.). Among the ultra-low temperature refrigerants, liquid nitrogen which is chemically inactive is especially suitable for use in this invention.

The manner in which the mixture of fatty components is brought to contact with the refrigerant can be either direct or indirect, but the process using direct contact is more advantageous since direct contact achieves better thermal efficiency and is accompanied by fine division of the solid particles due to embrittlement and easy removal of the refrigerant by volatilization.

The amounts of the ultra-low temperature refrigerants to be used are at least such amounts that are necessary and sufficient to solidify the mixture of fatty components but they are usually used in somewhat excess amounts from the viewpoint of workability.

More particularly, typical amounts, which can be varied depending on the purpose of the fractionation, the species of the mixture of fat or oil and the species of the ultra-low temperature refrigerant used, are in the range of 1~20 times by weight, and preferably 2~10 times by weight.

Solid-liquid separation can be carried out in such a manner that after the ultra-low temperature refrigerant which has been used for cooling the mixture of the fatty components to produce a solidified product is first separated and removed by means of decantation or the like, the resultant solidified product is heated to a predetermined temperature, thereby producing a melted product which is then separated by conventional means such as filtration, centrifugation or the like.

The separation efficiency can be improved by the addition of a specific solvent into the said solidified product, followed by heating the obtained mixture before the separation step wherein the specified component contained in the solidified product is separated by heating, whereby the specified component is melted for separation. The used solvent is removed from the extraction liquid and the solid residue by a conventional process under vacuum or in an ambient atmosphere of a nitrogen gas, steam, etc.

As the specific solvent, there are mentioned a nonpolar solvent such as n-hexane or benzene, a polar solvent such as methanol, ethanol or acetone, a solvent of intermediate nature such as ethyl ether and a mixture of the solvents.

According to the process of this invention, a specified component is concentrated or separated by rapidly refrigerating the mixture of fatty compounds containing the said specified component to solidify the mixture, followed by heating it to a specified temperature which is then maintained for a short time. The conventional process needs not only a long time for the formation and growth of the crystals of the specified component, but also the formation and growth of the crystals are repeated since the resulting crystals are contaminated by other components.

Therefore, the fractionation can be carried out in a very short time in the process of this invention as compared with the conventional process.

According to the process of this invention, the fractionation efficiency is higher than in the conventional process, since the melted component is not contaminated by other components when the mixture of the fatty compounds is solidified by using the ultra-low temperature refrigerant followed by heating of the solidified product to the specified temperature to melt mainly the specified component.

In addition, according to this invention, a chemically unstable substance such as highly unsaturated fatty acid, can be easily fractionated and isolated, since the mixture of fatty components containing the specified component is treated at an ultra-low temperature in a short time so as to enable the specified component to be fractionated from the mixture.

Further, according to this invention, it is possible to save energy and labor with excellent fractionation efficiency and also to simplify the necessary installations, because the separation can be done in a critical manner in a short separation step.

This invention is further illustrated in the following Examples, which do not restrict the scope of this invention.

The percentage values are in percent by weight, except as otherwise stated.

PREFERRED EMBODIMENTS OF THE INVENTION

EXAMPLE 1

Into a 10 l Dewar vessel provided with a stirrer were charged 3.0 kg of liquid nitrogen. 1.0 kg of methyl esters of cuttlefish liver oil having an iodine value of 220.0, which had been purified by distillation, was gradually poured into the vessel under stirring to disperse and solidify the same.

Then, after the stirring was continued for 10 minutes, the contents of the vessel were left standing for 10 minutes and the resultant supernatant liquid nitrogen was separated and be removed by decantation.

While stirring the granules of the cuttlefish liver oil remaining in the Dewar vessel, there were gradually poured in 5.0 kg of acetone which had been cooled in advance to −60° C. by a dry ice-methanol refrigerant, thereby to disperse the solid granules.

The temperature of the dispersion became −70° C.

Extraction was carried out in the Dewar vessel by stirring the contents in the temperature range of −61° to −60° C. and then the contents were filtered at that temperature. The resultant extraction filtrate was subjected to evaporation under vacuum to remove the solvent whereby to obtain 310 g of a fractionated oil. This fractionated oil contained physiologically active $C_{20:4}\omega_3$, $C_{20:5}\omega_3$, $C_{22:5}\omega_3$ and $C_{22:6}\omega_3$ in the sum amount $\Sigma\omega_3(>C_{20})$ of 76.3%. The term represents $\omega_3$ the compounds in which the double bonds of the fatty acids were located in the third positions from the terminal methyl groups. The sum amount $\Sigma 107_3$ means those $\omega_3$ compounds having at least 20 carbons. The iodine value of the fractionated oil was 341.0. These values were compared with the sum amount of 37.0% of the fatty acids of $\omega_3$ having at least 20 carbons and having an iodine value of 220.0 in the starting methyl ester of cuttlefish liver oil. From the comparison, it was apparent that a remarkable fractionation effect was achieved by the fractionated oil prepared in this Example. Determination of the fatty acids was carried out by gas chromatography of the methyl esters.

EXAMPLE 2

The methyl esters of cuttlefish liver oil used in Example 1 were saponified by an alkali in a conventional way and 1.0 kg of the resultant sodium soap was solidified in the same manner as in Example 1.

After the separation of the liquid nitrogen, a resultant solid granule were brought to a temperature of −30° C.

by using 5 kg of methanol and were kept at that temperature for 20 minutes to extract the fused components.

After the extraction, the extracted liquid was separated from the solid components and the liquid was subjected to removal of the solvent to produce a fractionated oil. The yield was 271.2 g and the sum amount of fatty acids of $\omega_3$ having at least 20 carbons $\Sigma\omega_3(>C_{20})$ was 70.8%. The iodine value of the product was 329.

EXAMPLE 3

1.0 kg of fatty acids, which was prepared by saponifying at room temperature the methyl esters of cuttlefish liver oil used in Example 1, followed by the acid decomposition, was solidified by using liquid nitrogen in the same manner as in Example 1 and then the liquid nitrogen was removed.

Into the resultant granules, there were added 5 kg of n-hexane and the resultant mixture was extracted at −50° C. for 15 minutes. The extraction liquid was separated and removal of the solvent was carried out to produce a fractionated oil.

The yield of the fractionated oil was 329 g. The content of fatty acids of $\omega_3$ having at least 20 carbons was 74.8% and the iodine value of the product was 338.

EXAMPLE 4

500 g of a solidified product obtained by solidifying the methyl esters of cuttlefish liver oil, prepared under the same conditions as in Example 1, were heated while stirring to raise the temperature to −50° C. The resultant solid-liquid mixture was charged in a centrifugal separator of the basket type and separation was carried out to separate the liquid and solid phases whereby to yield 210 g of liquid phase components and 258 g of solid phase components. It was found that the iodine value of the liquid components was 322 and the sum concentration of $\omega_3$ acids having at least 20 carbons was 64.5%. As is obvious from the results, it was found that the separation according to this invention was superior to that of the conventional one as described in the following comparative test 1 either in $\omega_3$ acid concentration and the yield thereof.

Comparative Test 1

500 g of the methyl esters of cuttlefish liver oil used in Example 1 were dissolved in 5 kg of acetone and the resultant solution was charged in a cooling apparatus provided with a cooling jacket and filtration means. The content was subsequently cooled to temperatures of −20° C., −40° C. and −60° C. in that order, and during the course of the cooling each temperature was maintained for 10 hours.

The crystals which were deposited at each temperature were filtered to separate them. The final fractionated oil was obtained at −60° C. in the amount of 115 g. The recovery was 23% based on the used methyl esters of liver oil.

The sum amounts of fatty acids of $\omega_3$ having at least 20 carbons were 61.8% and the iodine value was 303.

On the other hand, the separation of components which should fuse at −60° C. was not successful in the case wherein the methyl esters of liver oil were directly cooled to −60° C. since the entire composition was solidified.

EXAMPLE 5

1.0 kg of fatty acid methyl esters prepared from a purified sardine oil at room temperature was solidified by using liquid nitrogen. After solidification, liquid nitrogen was removed and the resultant solid granules were extracted at −60° C. for 10 minutes by using 5 kg of acetone. A fractionated oil was obtained in the amount 292 g.

The fatty acid contents in the starting material were as follows:

$C_{20:4}\omega_3$; 0.55%
$C_{20:5}\omega_3$; 9.5%
$C_{22:5}\omega_3$; 1.2%
$C_{22:6}\omega_3$; 7.0%

The contents in the fractionated oil were as follows:

$C_{20:4}\omega_3$; 1.2%
$C_{22:5}\omega_3$; 20.7%
$C_{22:5}\omega_3$; 2.1%
$C_{22:6}\omega_3$; 14.2%
$\Sigma\omega_3(>C_{20})$; 38.2%

Comparative Test 2

500 g of the same fatty acid methyl esters of sardine oil as used in Example 4 were fractionated in the same manner as in comparative Test 1, by using the same apparatus as used in Example 4. As a result, the recovery of the oil fractionated at −60° C. was 108 g (21.6%) $\Sigma\omega_3(>C_{20})$ was 25.1%.

In order to fractionate the components to be fused at −60° C., it was necessary to carry out preliminary fractionations at −20° C. and −40° C.

EXAMPLE 6

0.5 kg of a tallow fatty acids having the composition of 4.2% of myristic acid, 22,8% of palmitic acid, 16.6% of stearic acid, 47.0% of oleic acid, 7.9% of linoleic acid and 1.5% of linolenic acid was heated to fuse and was charged into a separating funnel.

On the other hand, 2.5 kg of liquid nitrogen were introduced into a Dewar vessel provided with a stirrer. Then, the bovine tallow was added dropwise into the liquid nitrogen from the separating funnel, while the content of the Dewar vessel was stirred. After the completion of the addition the content was further stirred for an additional 10 minutes to solidify the bovine tallow. After removal of the liquid nitrogen from the content of the Dewar vessel, 5.0 kg of n-hexane were added to the content, which was then heated under stirring to raise the temperature. It was kept at −20° C. for 10 minutes to extract the oleic acid component by n-hexane.

The resultant extraction solution was separated from the solid components and subjected to a removal of the solvent to give the oleic acid component. The product was obtained in the amount of 0.275 kg, in which the content of oleic acid was 78.1% as determined by gas chromatography.

The product had an iodine value of 93.5, whose value was raised from that of 65.0 of the starting material.

Comparative Test 3

500 g of the bovine tallow fatty acid used in Example 5 were dissolved in 5 kg of n-hexane. The resultant solution was charged into the same apparatus as used in Comparative Test 1 and the content was maintained at 20° C., 0° C. and −20° C. for 10 hours each in the same manner as in Comparative Test 1.

Crystals which were deposited at each temperature were filtered and collected. As a result, the product of oleic acid fraction was obtained in the final fractionation carried out at −20° C. in the amount of 289 g (yield 57.8%) and contained oleic acid in the amount of 69.1%. The iodine value was 83.3.

EXAMPLE 7

500 g of soy bean fatty acids having the composition of 11.5% of palmitic acid, 4.2% of stearic acid, 23.1% of oleic acid, 53.8% of linoleic acid and 7.4% of linolenic acid and also having an iodine value of 131 were solidified in the same manner as in Example 5.

Into the resultant solidified product were added 5 kg of acetone to produce a mixture, which was heated to the temperature of −20° C.

The mixture was maintained at that temperature for 10 minutes to extract and separate linoleic acid and linolenic acid. A mixture of linoleic acid and linolenic acid was obtained in the amount of 372 g. Gas chromatography thereof showed that the mixture contained 79.5% of linoleic acid, 10.9% of linolenic acid and 9.6% of others. The mixture had an iodine value of 178.

Comparative Test 4

500 g of the soy bean fatty acids used in Example 7 were dissolved in 5 kg of acetone. The resultant solution was maintained in the same apparatus used in Comparative Test 1 at temperatures of 20° C., 0° C. and −20° C. for 10 hours each in the same manner as in Comparative Test 1, wherein heating was applied to the solution in this order of temperature.

Removal of the solvent from the product deposited at −20° C. gave a product containing linoleic acid and linolenic acid as the main components. The yield of the product was 348 g.

Gas chromatography gave the analytical results that the product contained linoleic acid and linolenic acid in the amounts of 70.8% and 8.9%. respectively, and other acids in the amount of 20.3%. The iodine value of the product was 147.

EXAMPLE 8

There were charged 500 g of liquid nitrogen into a 2 l Dewar vessel provided with a stirrer, and then 100 g of a peppermint oil were charged under stirring to disperse and solidify the same.

Then, after stirring was continued for 10 minutes, the liquid nitrogen was separated from the contents of the vessel, whereupon 600 g of ethyl alcohol were added and stirred.

The obtained mixture was heated up to −35° C. and kept at that temperature for 10 minutes, and the obtained liquid phase was filtered off.

From said liquid phase, ethyl alcohol was removed under reduced pressure, thereby obtaining 141 g of the product (designated as fraction A), which consisted of 35.5% of l—limonene, 25.5% of α—pinene, 23.9% of isovaleric aldehyde, 3.0 of furfural and 2.1% of other components.

The remaining solid matter obtained by filtering the fraction A was admixed with 500 g of ethanol and was mixed while stirring. The obtained mixture was kept at a temperature of −5° C. for 10 minutes and the obtained mixture was subjected to desolvent procedure, thereby obtaining 27.9 g of the product B (hereinafter designated as fraction B) which consisted of 93.3% of menthone and 6.7% of other components.

The yield of the filtration solid matter (designated as fraction C) which was obtained by filtering off the fraction B, was 58.0 g and its composition consisted of 94.8% of l-menthol and 5.2% of other components.

It is apparent from these results that according to the present invention, the fraction A having special components which have not been obtained by the conventional methods, can be obtained and, further, menthone and l-menthol can be obtained respectively in a high degree and also the separation can be done in a very short time.

The embodiments of the invention in which an exclusive property or privilege is claimed are defined as follows:

1. A process for fractionating a starting mixture of crystallizable fatty components, which comprises the steps of:
   (a) cooling the entirety of said starting mixture, free of solvent, with an ultra-low temperature refrigerant to solidify the entirety of said starting mixture and produce a brittle, solid, granular product;
   (b) raising the temperature of said granular product to a first temperature which corresponds to or is slightly higher than the freezing point of the component of said starting mixture having the lowest freezing point, thereby melting a first fraction containing, as its main component, said component of said starting mixture that has the lowest freezing point, while retaining the remainder of said granular product as a first solid phase; and
   (c) then separating said molten, first fraction from said first solid phase and recovering said first fraction.

2. A process for fractionating a starting mixture of crystallizable fatty components into a plurality of fractions, which comprises the steps of:
   (a) cooling the entirety of said starting mixture, free of solvent, with an ultra-low temperature refrigerant to solidify the entirety of said starting mixture and produce a brittle, solid, granular product;
   (b) raising the temperature of said granular product to a first temperature which corresponds to or is slightly higher than the freezing point of the component of said starting mixture having the lowest freezing point, thereby melting a first fraction containing, as its main component, said component of said starting mixture that has the lowest freezing point, while retaining the remainder of said granular product as a first solid phase;
   (c) then separating said molten, first fraction from said first solid phase and recovering said first fraction;
   (d) then raising the temperature of said first solid phase to a second temperature which is higher than said first temperature and which corresponds to or is slightly higher than the freezing point of the component of said first solid phase having the lowest freezing point, thereby melting a second fraction containing, as its main component, said component of said first solid phase that has the lowest freeizing point, while retaining the remainder of said first solid phase as a second solid phase;
   (e) then separating said molten second fraction from said second solid phase and recovering said second fraction; and
   (f) repeating steps (d) and (e) using the solid phase obtained from the immediately preceding separation step (e) and using progressively higher temperatures whereby to separately recover additional fractions containing other components of said starting mixture.

3. A process for fractionating a starting mixture of crystallizable fatty components, which comprises the steps of:

(a) cooling the entirety of said starting mixture, free of solvent, with an ultra-low temperature refrigerant to solidify the entirety of said starting mixture and produce a brittle, solid, granular product;

(b) admixing said granular product with a liquid solvent;

(c) raising the temperature of the mixture of said granular product and said solvent to a first temperature which corresponds to or is slightly higher than the freezing point of the component of said starting mixture having the lowest freezing point, thereby melting a first fraction containing, as its main component, said component of said starting mixture that has the lowest freezing point and extracting said first fraction into said solvent to form a first liquid extract, while retaining the remainder of said granular product as a first solid phase; and (d) then separating said first liquid extract from said first solid phase, removing said solvent from said first liquid extract and recovering said first fraction.

4. A process for fractionating a starting mixture of crystallizable fatty components into a plurality of fractions, which comprises the steps of:

(a) cooling the entirety of said starting mixture, free of solvent, with an ultra-low temperature refrigerant to solidify the entirety of said starting mixture and produce a brittle, solid, granular product;

(b) admixing said granular product with a liquid solvent;

(c) raising the temperature of the mixture of said granular product and said solvent to a first temperature which corresponds to or is slightly higher than the freezing point of the component of said starting mixture having the lowest freezing point, thereby melting a first fraction containing, as its main component, said component of said starting mixture that has the lowest freezing point and extracting said first fraction into said solvent to form a first liquid extract, while retaining the remainder of said granular product as a first solid phase;

(d) then separating said first liquid extract from said first solid phase, removing said solvent from said first liquid extract and recovering said first fraction;

(e) then admixing said first solid phase with a liquid solvent;

(f) then raising the temperature of the mixture of said first solid phase and said solvent to a second temperature which is higher than said first temperature and which corresponds to or is slightly higher than the freezing point of the component of said first solid phase having the lowest freezing point, thereby melting a second fraction containing, as its main component, said component of said first solid phase that has the lowest freezing point and extracting said second fraction into said solvent to form a second liquid extract while retaining the remainder of said first solid phase as a second solid phase;

(g) then separating said second liquid extract from said second solid phase, removing said solvent from said second liquid extract and recovering said second fraction; and (h) repeating steps (e), (f) and (g) using the solid phase obtained from the immediately preceding separation step (g) and using progressively higher temperatures whereby to separately recover additional fractions containing other components of said starting mixture.

5. A process as claimed in claim 1, claim 2, claim 3 or claim 4 in which said step (a) is performed by mixing said starting mixture with liquid ultra-low temperature refrigerant until the entirety of said starting mixture is solidified and then decanting said refrigerant from said granular product.

6. A process as claimed in claim 5 in which the amount of said refrigerant is from 1 to 20 parts by weight per 1 part by weight of said starting mixture.

7. A process as claimed in claim 5 in which said refrigerant is liquid nitrogen.

8. A process as claimed in claim 1, claim 2, claim 3 or claim 4 in which said starting mixture is selected from the group consisting of animal oils and fats, vegetable oils and fats, cracked products and derivatives of said oils and fats, perfumes and essential oils.

9. A process as claimed in claim 3 or claim 4 in which said solvent is selected from the group consisting of n-hexane, acetone and methyl alcohol.

10. A process as claimed in claim 1, claim 2, claim 3 or claim 4 in which said starting mixture is a fish oil or liver oil containing unsaturated fatty acids or derivatives thereof having at least 20 carbon atoms and having a double bond located at the third position from the terminal methyl group.

* * * * *